US007143465B2

(12) United States Patent
Furrer et al.

(10) Patent No.: US 7,143,465 B2
(45) Date of Patent: Dec. 5, 2006

(54) APPARATUS FOR CLEANING TONER CARTRIDGES

(75) Inventors: Stefan Furrer, Tagerwilen (CH); Thierry Torrent, Scherzingen (CH)

(73) Assignee: Futor Cleaning System AG, Tagerwilen (CH)

( * ) Notice: Subject to any disclaimer, the term of this patent is extended or adjusted under 35 U.S.C. 154(b) by 252 days.

(21) Appl. No.: 10/345,408

(22) Filed: Jan. 16, 2003

(65) Prior Publication Data

US 2004/0010883 A1 Jan. 22, 2004

(30) Foreign Application Priority Data

Jul. 17, 2002 (CH) ..... 1248/02

(51) Int. Cl.
*A47L 5/14* (2006.01)

(52) U.S. Cl. ..... 15/309.2; 15/306.1

(58) Field of Classification Search ..... 15/306.1, 15/307, 308, 309, 309.2, 316.1, 345, 346; 134/70, 72, 128, 131; 198/473.1, 474.1
See application file for complete search history.

(56) References Cited

U.S. PATENT DOCUMENTS 2,644,188 A * 7/1953 Pacilio ..... 15/304
2,644,473 A * 7/1953 Fox et al. ..... 134/72
3,805,317 A 4/1974 Dickinson
3,849,831 A * 11/1974 DeVerter et al. ..... 15/302
4,198,725 A * 4/1980 Trutzschler ..... 15/309.2
4,317,514 A * 3/1982 Noren ..... 198/803.13
4,411,038 A * 10/1983 Mukai ..... 15/3.13
5,265,298 A 11/1993 Young
5,351,354 A 10/1994 Hasumi et al.
5,421,690 A * 6/1995 Litterst ..... 414/418
5,661,872 A * 9/1997 Meyer et al. ..... 15/309.2
6,205,676 B1 * 3/2001 Fujii et al. ..... 34/250
6,543,078 B1 * 4/2003 Ernst et al. ..... 15/1.51

FOREIGN PATENT DOCUMENTS

DE 80 19 194 U 12/1980
DE 42 23 691 A 1/1994
FR 2 620 973 A 3/1989
GB 2 337 325 A 11/1999
WO WO 94/23348 A1 10/1994

* cited by examiner

*Primary Examiner*—Terrence R. Till
(74) *Attorney, Agent, or Firm*—Browdy and Neimark, PLLC

(57) ABSTRACT

An apparatus for cleaning toner cartridges by means of compressed air has at least one cleaning chamber (1, 2) and a conveyor line (3) leading through this at least one cleaning chamber (1, 2). The conveyor line (3) is provided with variable-position means of conveying individual parts (M, T, G) of toner cartridges. Variable-position compressed air nozzles (11) are arranged in the cleaning chambers (1, 2). This apparatus permits automatic, efficient, environmentally friendly cleaning of toner cartridges.

7 Claims, 6 Drawing Sheets

APPARATUS FOR CLEANING TONER CARTRIDGES

TECHNICAL FIELD

The invention relates to an apparatus for cleaning toner cartridges

PRIOR ART

Toner cartridges are used in laser printers, copiers, fax machines and the like. These toner cartridges substantially comprise a housing with a toner container, a magnetic drum and various small parts such as small wheels or clips. The exposure drum is generally also integrated into the cartridge.

Once the toner in the cartridge has been used up, it is normally disposed of and replaced in the printing appliance by a new cartridge. Increasingly, however, such toner cartridges are collected and professionally recycled. In this case, the toner cartridges are taken apart by hand, cleaned with compressed air, assembled again and then filled. At this opportunity, small parts and other parts more intensely subjected to wear are replaced. The expensive magnetic drum and the housing are reused, however. This purely manual cleaning of the toner cartridges has a number of disadvantages:

The working conditions are extremely poor, since the use of compressed air means that extremely fine toner particles are liberated and in this way get into the airway of the personnel. Since manual cleaning is time-consuming, the recycling costs are additionally relatively high. Furthermore, quality assurance is not ensured, since the personnel assess individually how long and how accurately compressed air is used to act on the individual cartridges. Above all, the magnetic drum must be cleaned carefully in order that the recycled toner cartridge also achieves the required print quality.

WO 94/23348 discloses an apparatus which is intended to permit quick and simple cleaning of toner cartridges and, in particular, is intended to ensure adequate cleaning of the magnetic drum. The apparatus has a frame to which the toner cartridge is fixed. On this frame there are propulsion means to drive the magnetic drum in order to clean the rotating magnetic drum with a cloth. Furthermore, the apparatus has an extraction connection in order to extract toner from the toner housing. This apparatus is also operated manually and therefore likewise has the aforementioned disadvantages. As an advantage as compared with compressed air cleaning, it is stated that compressed air can damage the individual parts. Since, here, the cassette as a whole is cleaned, there is the risk however that old toner will not be removed from parts which are difficult to access.

DESCRIPTION OF THE INVENTION

It is therefore an object of the invention to provide an apparatus which permits efficient, environmentally friendly cleaning of toner cartridges.

The apparatus according to the invention has at least one cleaning chamber with compressed air nozzles and a conveyor line leading through the latter, which transports disassembled toner cartridges through the cleaning chamber. In the cleaning chamber, the toner cartridges are cleaned with compressed air, the contaminated waste air being extracted. Each toner cartridge is therefore treated in the same way as the others. Since the application of compressed air is defined by the arrangement of the nozzles, the cartridges cannot be damaged by improper treatment.

In order to obtain the optimum cleaning result for each cartridge type, the compressed air nozzles are arranged such that their positions can be varied. For example, the apparatus can be rebuilt quickly and in a simple way, as a result of which the apparatus can be used for all cartridge types. This flexibility is additionally assisted by the use of a specifically shaped conveyor line. It comprises an endless grid from which fingers protrude.

The use of extraction chambers upstream and/or downstream of the cleaning chambers prevents toner dust being blown into the surroundings. The environmental loading and the risk to the health of the employees are minimized.

Further advantageous embodiments emerge from the dependent patent claims.

BRIEF DESCRIPTION OF THE DRAWING

In the following text, the subject matter of the invention will be explained by using preferred exemplary embodiments, which are illustrated in the attached figures, in which.

EMBODIMENTS OF THE INVENTION

Figure 1A:
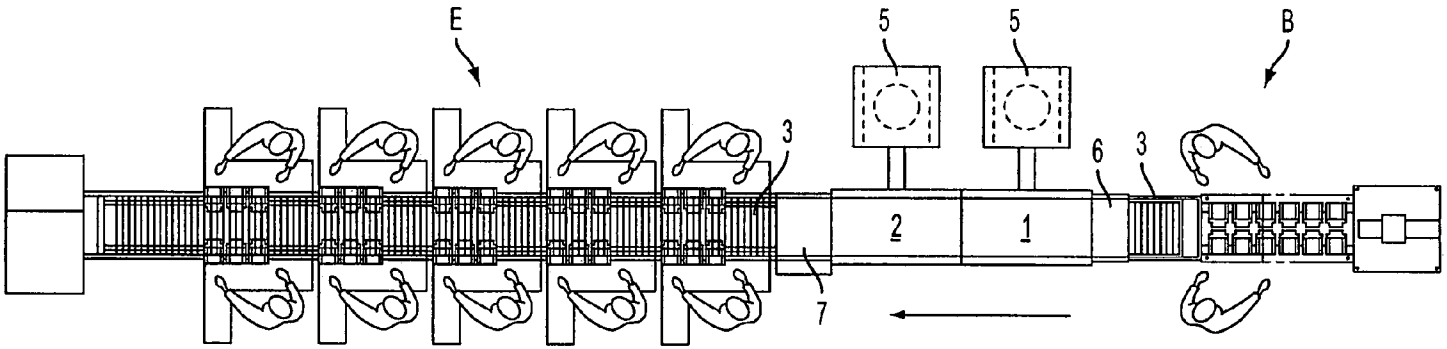
FIG. 1*a* shows a schematic illustration of the apparatus in a first embodiment from above.
Figure 1B:
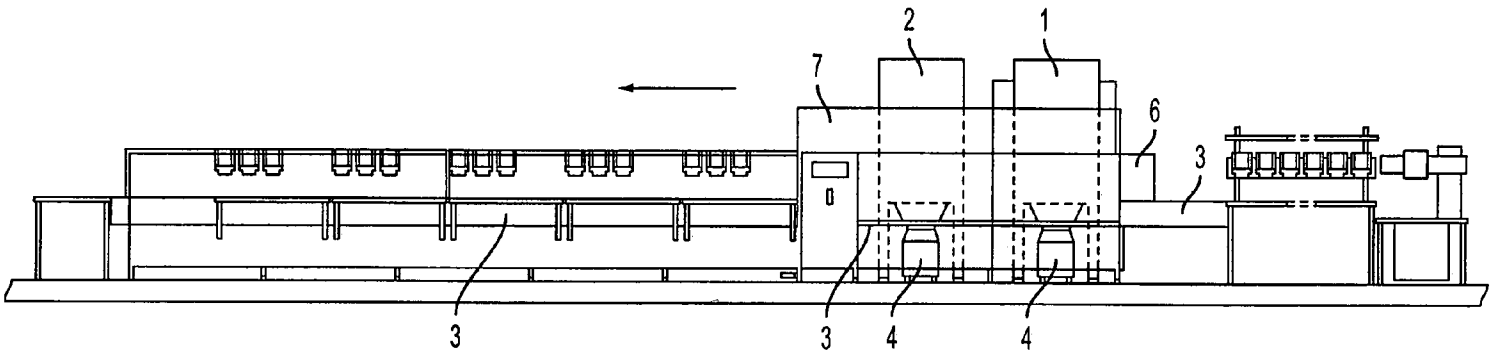
FIG. 1*b* shows the apparatus according to FIG. 1*a* from the side.

In FIGS. 1*a* and 1*b*, a first embodiment of the apparatus according to the invention is illustrated. It has at least one, here two, cleaning chambers 1, 2 with compressed air nozzles 11 and extraction units 5. A conveyor line 3 leads through the cleaning chambers 1, 2. The corresponding conveying direction is identified by an arrow in the figures. The individual cleaning chambers 1, 2 are preferably separated from one another by air locks or curtains. Each cleaning chamber 1, 2 is usually provided with its own extraction unit 5. Each cleaning chamber 1, 2 can have at least one dedicated compressor or a dedicated compressed air unit 4 for producing the compressed air. In the exemplary embodiment according to FIGS. 1*a* and 1*b*, the compressed air units 4 are in each case arranged underneath the chambers 1, 2, and the extraction units are arranged beside the chambers 1, 2. Upstream of the cleaning chambers 1, 2 in the conveying direction there is a loading station B, and downstream of the cleaning chambers 1, 2 in the conveying direction there is arranged an unloading station E. The loading and unloading stations B, E have one or more personal workplaces.

In order that toner particles from the cleaning chambers 1, 2 do not get into the surroundings, the inlet and the outlet of the cleanings section can preferably be closed with air locks or curtains. In a preferred embodiment, there is an extraction chamber 6, 7 upstream of the first cleaning chamber 1 in the conveying direction and/or downstream of the last cleaning chamber 2 in the conveying direction. Arranged in these extraction chambers 6, 7 are annular ducts which extract the toner particles floating in the air. However, it is to some extent also sufficient to configure the inlet and outlet regions of the first and last chambers 1, 2 to be sufficiently long.

Furthermore, in the region of the cleaning section, preferably in the last cleaning chamber 2, there is preferably a narrowed region in which compressed air nozzles 11 are specifically aimed from all sides at the magnetic drums M. As a result, the cleaning of the magnetic drums M is optimized. These nozzles 11 are preferably connected to a dedicated common compressed air unit.

Toner cartridges to be cleaned are disassembled in the loading station B. This means that the magnetic drum M and, if appropriate, the exposure drum T are dismantled by hand and small parts are removed from the toner housing G. In the process, any loose toner is shaken out of the toner housing G into a collecting container. It is also possible to arrange a collecting container underneath the loading station B and to extract toner with an extraction apparatus. The individual parts are likewise placed manually on the conveyor line 3. For this purpose, the conveyor line 3 has specific means for holding the individual parts, as described further below. The individual parts M, T, G are guided through the cleaning chambers 1, 2 on the conveyor line 3. Conveyance is normally carried out continuously. However, it can also be carried out step by step. In the cleaning chambers 1, 2, the individual parts M, T, G are acted on with compressed air and in this way cleaned of toner and dirt particles. The cleaned individual parts M, T, G pass into the unloading station E, where they are checked manually, if necessary recleaned, filled with toner and assembled again. The small parts are not necessarily cleaned and sent through the cleaning chambers 1, 2. They can also be disposed of directly in the loading station B and replaced by new parts during assembly in the unloading station E.

Figure 2A:
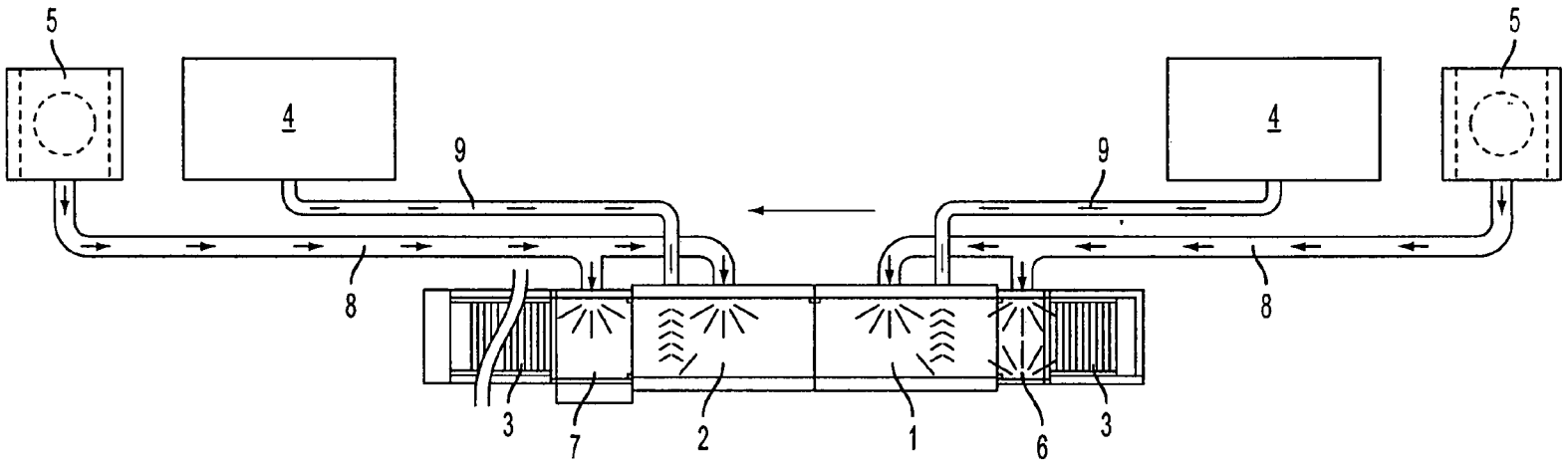
FIG. 2*a* shows a schematic illustration of the apparatus in a second embodiment from above.
Figure 2B:
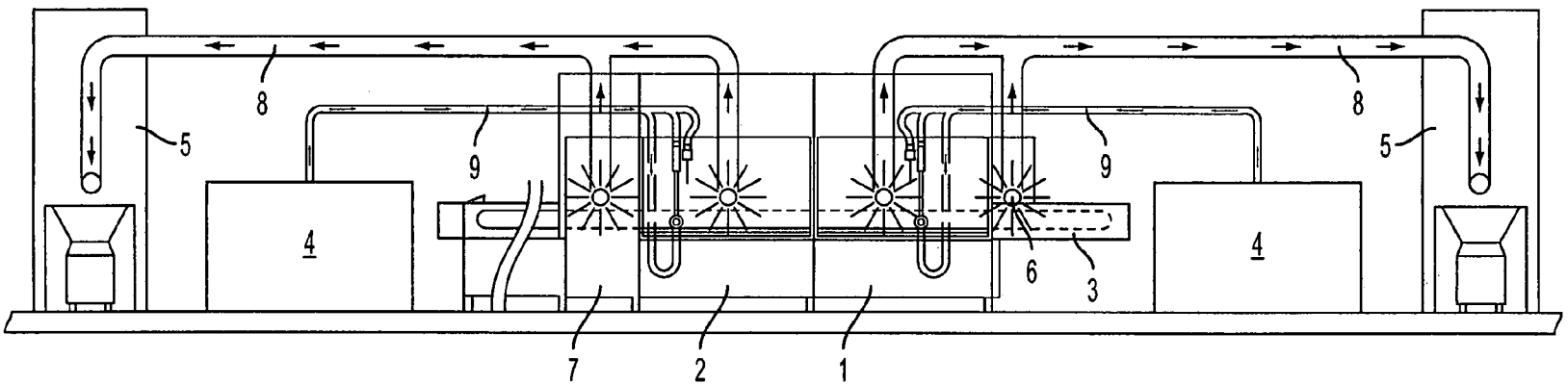
FIG. 2*b* shows the apparatus according to FIG. 2*a* from the side.

A second exemplary embodiment is illustrated in FIGS. 2*a* and 2*b*. Here, the extraction units 5 and the compressed air units 4 are arranged at a distance from the cleaning line and, via extraction ducts 8 and compressed air feed ducts 9, respectively, are connected to the cleaning chambers 1, 2 and the extraction chambers 6, 7. They can even be located in a different room. This arrangement has the advantage that these loud units 4, 5 are not in the region of the personal workplaces and therefore the noise loading on the personnel is minimized.

FIGS. 3*a* to 3*e* illustrate part of the conveyor line 3 having the means for conveying the individual parts of the toner cartridges. The toner housings G and the magnetic drums M are in this case preferably placed on the conveyor line 3 with their longitudinal axis at least approximately parallel to the conveying direction in order that these parts remain as long as possible in the cleaning chambers 1, 2.

The conveyor line 3 substantially comprises a motor-driven, circulating endless grid 30 which defines a conveying plane. The endless grid 30 is deflected around at least two deflection rolls 31. It has transverse rods 32 which are connected to one another in an articulated manner via longitudinal couplers 33. Arranged on the transverse rods 32 are fingers 34 which protrude upwards from the conveying plane. The fingers 34 are normally produced from plastic or metal. The fingers 34 are preferably arranged to be pivotable, it being possible for them preferably to be folded into the conveying plane in order to create space for the individual parts to be cleaned. The fingers 34 can also be removed from the endless grid 30 in a simple way in order likewise to provide space for the mounting of the individual parts. The arrangement of finger 34 is usually matched in a customer-specific manner to the endless grid 30, so that no further adaptations are needed during operation.

Figure 3A:
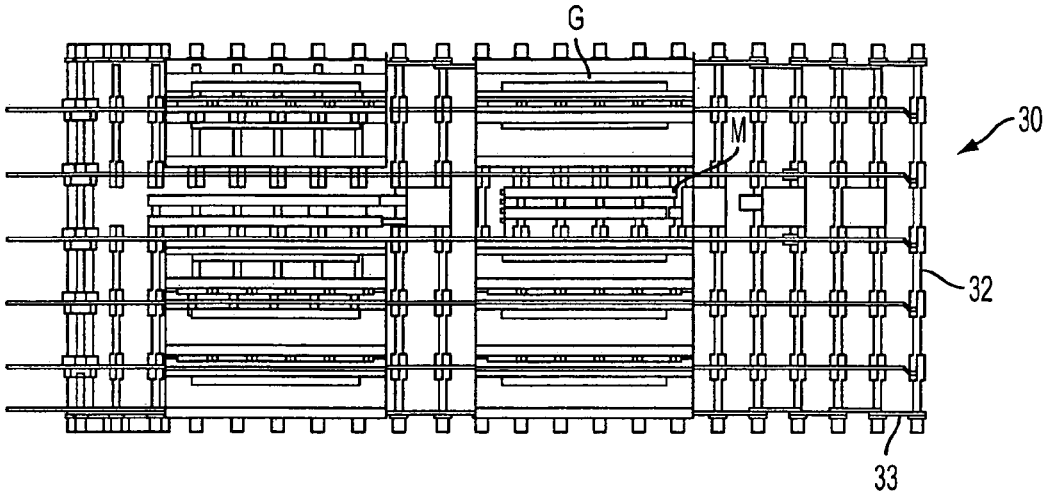
FIG. 3*a* shows a view of part of a conveyor line from above with magnetic drums and toner housings mounted.
Figure 3B:
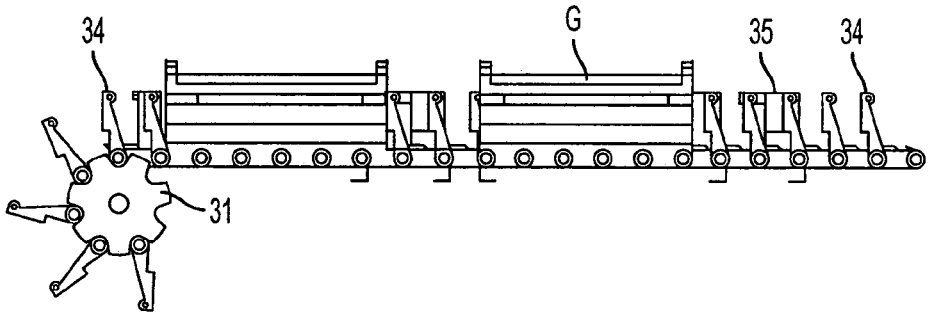
FIG. 3*b* shows a view from a first side of the conveyor line according to FIG. 3*a;*
Figure 3C:
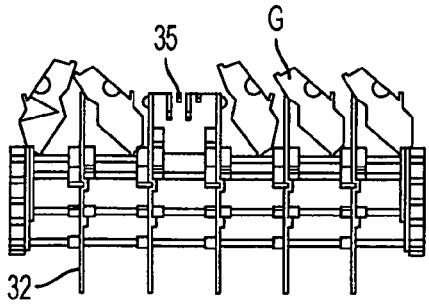
FIG. 3*c* shows a view from a second side of the conveyor line according to FIG. 3*a;*
Figure 3D:
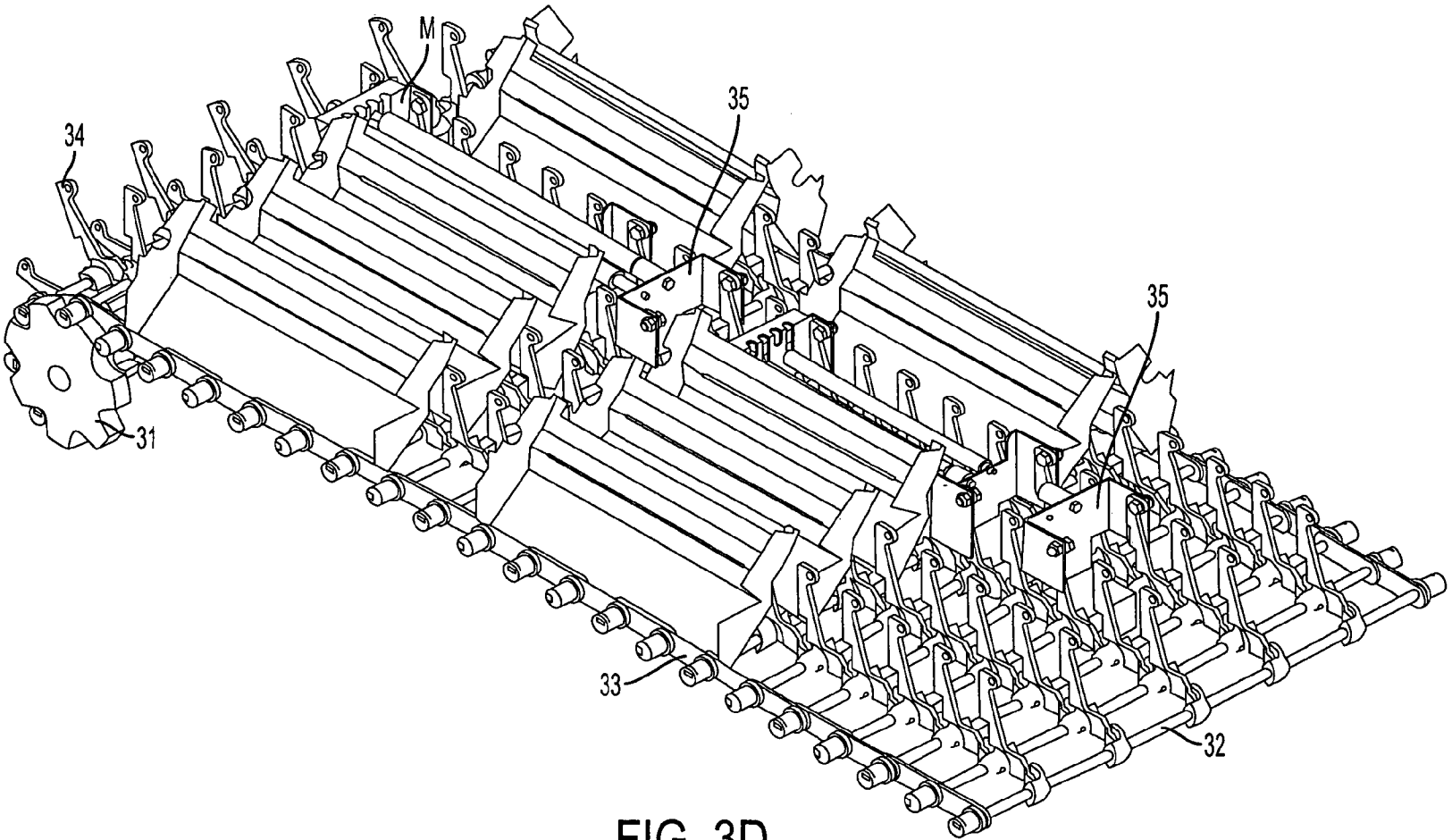
FIG. 3*d* shows a perspective illustration of the conveyor line according to FIG. 3*a;*
Figure 3E:
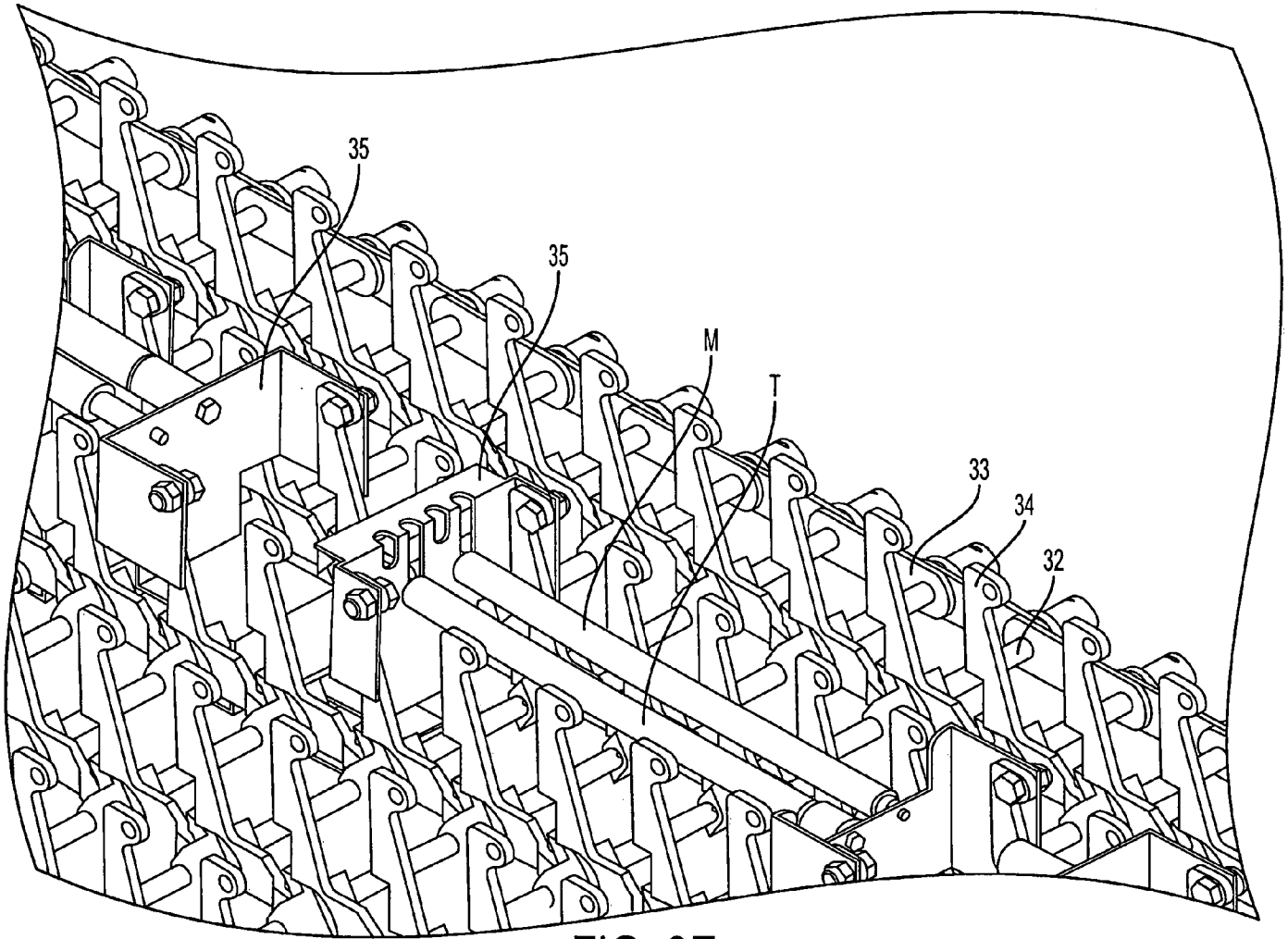
FIG. 3*e* shows an enlarged illustration of the conveyor line with fingers and adapter.

The toner housings G are placed between the fingers 34 and thus held. If the fingers 34 are designed to be slightly springy, the housings G can be clamped firmly between them. For the magnetic drums M and, if appropriate, the exposure drums T, there are adapters 35 which can be mounted on the fingers 34. These adapters 35 comprise a U-shaped clip, preferably of plastic or metal, which is screwed to two fingers 34 at two flanks, as can be seen in FIG. 3*e*. Other types of fastening are possible. The adapters 35 have guide slots, into which the drums M, T can be inserted from above, and/or they have through holes into which the drums M, T can be pushed. In each case two adapters 35 thus hold the drums M, T firmly on both sides, it being possible for a plurality of drums M, T to be held beside one another by the same adapters 35. This conveyor line permits customer-specific adaptation, also dependent on the toner cartridge type, of the apparatus in a simple way.

Figure 6A:
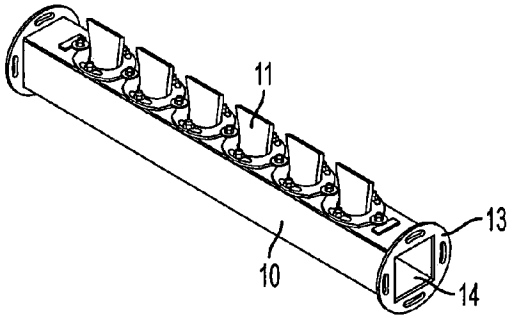
FIG. 6*a* shows a perspective illustration of a compressed air bar with nozzles in a third embodiment.
Figure 6B:
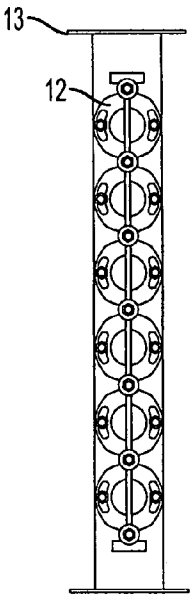
FIG. 6*b* shows a view of the compressed air bar according to FIG. 6*a* from above.
Figure 4A:
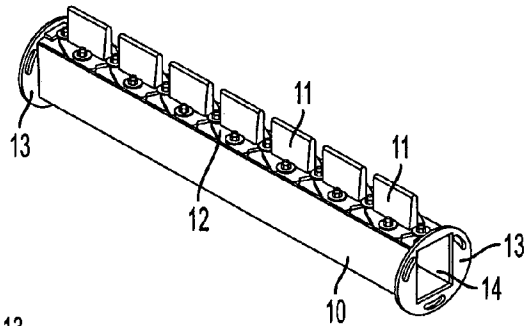
FIG. 4*a* shows a perspective illustration of a compressed air bar with nozzles in a first embodiment.
Figure 4B:
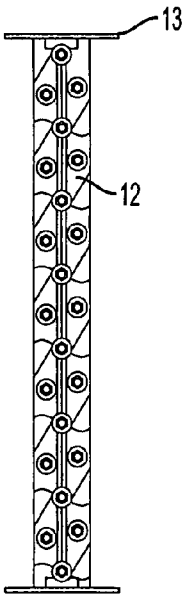
FIG. 4*b* shows a view of the compressed air bar according to FIG. 4*a* from above.

As already mentioned above, there are compressed air nozzles 11 in the cleaning chambers 1, 2. The arrangement and form of the nozzles 11 depends on the type of toner cartridges to be cleaned. Likewise, the opening cross section of the nozzles is selected appropriately. In the figures, slotted nozzles are illustrated. Other shapes are possible. It is also possible to use nozzles with different opening cross sections together. The nozzles 11 are arranged in a customer-specific manner and, when the cassette types are changed, are to some extent replaced. These nozzles also permit simple and quick adaptation of the cleaning line to new types. For this purpose, a plurality of nozzles 11 are in each case fixed jointly to a hollow compressed air bar 10, as illustrated by way of example in FIGS. 4*a* and 4*b*. The compressed air bar 10 has a compressed air feed opening 14 to connect to the compressed air feed of the compressed air unit 4, and appropriate openings for passing the compressed air on to the nozzles 11. On both sides, the bar 10 has a fastening flange 13 which is provided with elongated holes. In this way, its fastening position can be varied as desired. The nozzles 11 are likewise fastened to the bar via fastening flanges 12 with elongated holes, so that their position relative to the bar 10 and to the chamber 1, 2 can also be adapted individually, in particular displaced and pivoted. In FIGS. 4*a* and 4*b*, the fastening flanges 12 of the nozzles 11 have a rhomboidal cross section. In the embodiment according to FIGS. 6*a* and 6*b*, they are circular.

Figure 5:
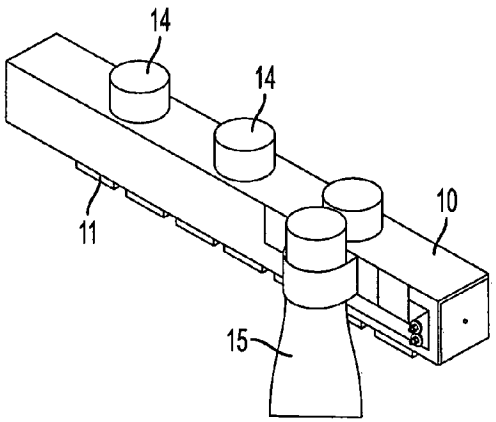
FIG. 5 shows a perspective illustration of a compressed air bar with nozzles in a second embodiment.

In the embodiment according to FIG. 5, the bar 10 has a plurality of openings 14 for the compressed air feed, which are arranged distributed over the bar 10. Furthermore, an external nozzle 15 is arranged on the outside of the bar 10 and can be connected directly to the compressed air feed of the compressed air unit 4.

Thus, in particular by virtue of the variable-position means for conveying individual parts and the variable-position nozzles, this apparatus permits automatic, efficient and environmentally friendly cleaning of toner cartridges.

LIST OF REFERENCE SYMBOLS

B Loading station
E Unloading station
G Toner housing
M Magnetic drum
T Exposure drum
1 First cleaning chamber
10 Compressed air bar
11 Compressed air nozzle
12 Fastening flange of the nozzle
13 Fastening flange of the bar
14 Compressed air feed opening
15 External compressed air nozzle
2 Second cleaning chamber
3 Conveyor line
30 Endless grid
31 Deflection roll
32 Transverse rods
33 Longitudinal coupler
34 Finger
35 Adapter
4 Compressed air unit
5 Extraction unit
6 Front extraction chamber
7 Rear extraction chamber
8 Extraction duct
9 Compressed air feed duct

The invention claimed is:

1. Apparatus for cleaning toner cartridges by means of compressed air, said apparatus comprising: at least one cleaning chamber (1, 2); a conveyor line (3) leading through said at least one cleaning chamber (1, 2), said conveyor line (3) having means (34, 35) for conveying individual parts (M, T, G) of toner cartridges; compressed air nozzles (11) arranged in said cleaning chamber (1, 2); and an extraction chamber (6, 7) in line with said at least one cleaning chamber and above said conveyor line, said extraction chamber being arranged upstream of the first cleaning chamber (1) in the conveying direction and/or downstream of the last cleaning chamber (2) in the conveying direction, wherein the conveyor line (3) has a circulating endless grid (30) which forms a conveying plane, and the means of conveying individual parts (M, T, G) of toner cartridges comprise fingers (34) protruding from the conveying plane and pivotably mounted to said grid to be capable of being folded into the conveying plane.

2. Apparatus according to claim 1, wherein the compressed air nozzles (11) are arranged such that their position can be varied in dependence on the toner cartridge to be cleaned.

3. Apparatus according to claim 1, wherein at least some of said means (34, 35) of conveying individual parts (M, T, C) are arranged such that their position can be varied with respect to the conveyor line.

4. Apparatus according to claim 1, wherein a plurality of compressed air nozzles (11) are arranged on a common compressed air bar (10), which is adapted to be connected to a common compressed air feed.

5. Apparatus according to claim 1, wherein a plurality of cleaning chambers (1, 2) are arranged one after another in the conveying direction.

6. Apparatus according to claim 1, wherein the apparatus has at least one compressed air unit (4) for producing the compressed air and at least one extraction unit (5) for extracting the waste air, the at least one compressed air unit (4) and the at least one extraction unit (5) being arranged at a distance from the cleaning line formed by cleaning chambers (1, 2) and conveyor line (3).

7. Apparatus according to claim 1, wherein magnetic drums (M) and housings (C) of the toner cartridges are adapted to be conveyed with their longitudinal axis parallel to the conveying direction.

* * * * *